United States Patent [19]

Schmidtchen et al.

[11] Patent Number: 4,792,661

[45] Date of Patent: Dec. 20, 1988

[54] ELECTRIC HEATING APPARATUS FOR REGULATING THE TEMPERATURE OF A PLURALITY OF LIQUIDS

[75] Inventors: Gerhard Schmidtchen, Sachsenheim; Mathias Muller, Oberstenfeld, both of Fed. Rep. of Germany

[73] Assignee: Durr Dental GmbH & Co KG, Bietigheim-Bissingen, Fed. Rep. of Germany

[21] Appl. No.: 840,002

[22] Filed: Mar. 17, 1986

[30] Foreign Application Priority Data

Mar. 16, 1985 [DE] Fed. Rep. of Germany ..... 3509609

[51] Int. Cl.[4] ..... H05B 1/02; F24H 1/14

[52] U.S. Cl. ..... 219/301; 99/288; 138/33; 165/30; 165/140; 219/302; 219/308; 219/540

[58] Field of Search ..... 219/283, 296–299, 219/301–305, 530, 540; 165/30, 40, 140, 141; 99/281, 306, 307, 288; 138/33

[56] References Cited

U.S. PATENT DOCUMENTS

| | | | |
|---|---|---|---|
| 2,445,115 | 7/1948 | Hanrahan | 165/141 |
| 2,576,558 | 11/1951 | Bede | 219/302 X |
| 2,578,280 | 12/1951 | Barnard | 219/301 |
| 2,612,357 | 9/1952 | Parks | 165/140 X |
| 2,673,919 | 3/1954 | Arvins et al. | 219/302 |
| 2,852,232 | 9/1958 | Marwell | 165/30 |
| 3,592,125 | 7/1971 | Tolmie et al. | 99/307 |
| 4,480,172 | 10/1984 | Ciciliot et al. | 165/140 X |

FOREIGN PATENT DOCUMENTS

| | | | |
|---|---|---|---|
| 1199070 | 8/1965 | Fed. Rep. of Germany | 138/33 |
| 2340489 | 2/1975 | Fed. Rep. of Germany | 219/302 |
| 2701692 | 7/1978 | Fed. Rep. of Germany | 219/301 |
| 3509609 | 9/1986 | Fed. Rep. of Germany | 219/301 |
| 2173581 | 10/1986 | United Kingdom | 219/301 |

*Primary Examiner*—Anthony Bartis

*Attorney, Agent, or Firm*—Fred Philpitt

[57] ABSTRACT

Apparatus for adjusting the temperature of a plurality of liquids which includes temperature adjusting means having a corresponding plurality of separate flow paths, a pump arrangement for circulating the liquids through said separate paths and means for maintaining predetermined temperature differences between the liquids, wherein the temperature adjusting means includes a single temperature controlling member and a number of pipes which correspond in number to the number of separate flow paths for the liquids of which the temperatures are to be adjusted. The temperature controlling member and the pipes are interconnected in heat conducting so that the total thermal impedance between the first of said pipes and the temperature controlling member integrated from the inlet end to the outlet end of said first pipe differs from the corresponding total thermal impedance of at least a second of said pipes. The first of said pipes is located directly in heat conducting manner on the temperature controlling member and said at least second of said pipes is carried by said first of said pipes in a heat conducting manner. The thermal impedance defined between said at least second of the pipes and the temperature controlling member being thus formed by said first of the pipes.

13 Claims, 3 Drawing Sheets

ELECTRIC HEATING APPARATUS FOR REGULATING THE TEMPERATURE OF A PLURALITY OF LIQUIDS

The invention relates to an apparatus for regulating the temperature of a plurality of liquids.

Known apparatus of this type comprise a plurality of temperature-regulating members serving for heating and/or cooling, which are each associated with one of the liquids of which the temperature is to be regulated. Immersed respectively in the liquids of which the temperature is to be regulated is a temperature sensor and a central control device receives the output signals of the latter and controls the individual temperature-regulating members so that a predetermined temperature relationship between the individual liquids is maintained.

Temperature-regulating apparatus of this type indeed allow an adjustment of the temperature differences of the various liquids within wide ranges; however they are expensive as regards apparatus and if one of the temperature sensors fails it is possible that the desired temperature relationship between the various liquids is no longer maintained. However, for various applications, for example regulating the temperature of the developer liquid and of the fixing liquid in an automatic developing machine, it is necessary that at all events one liquid has a lower temperature than the second liquid. Otherwise irreparable damage may occur to the material being developed.

The present invention therefore intends to provide an apparatus for regulating the temperature of a plurality of liquids, in which independently of the correct operation of a temperature regulating/control device, it is always ensured that certain temperature ratios are maintained between the liquids of which the temperatures are to be regulated.

This object is achieved according to the invention by a temperature-regulating apparatus described hereinafter.

Since in the temperature-regulating apparatus according to the invention only a single temperature-regulating member is provided and the pipes for the various liquids of which the temperatures are to be regulated are connected to the latter by way of various, the direction of the desired temperature gradient between the liquids is necessarily guaranteed by the guidance of the heat flow and indeed even if the heating or cooling capacity of the temperature-regulating member, the circulation rates of the various liquids or the ambient conditions should vary in an uncontrollable manner in the case of disturbances.

With the above mentioned advantages, the temperature-regulating apparatus according to the invention is also characterised by a construction which is very simple and compact both mechanically and electrically.

In a pipe through which one of the liquids flows is used as the resistance member according to one embodiment increasing the thermal impedance to one of the pipes, then the entire temperature-regulating device has a particularly compact and mechanically simple construction, in which case the same material can be chosen as the raw material for the various pipes. This is of particular advantage as regards welding the pipes together and as regards simple storage.

The development of the invention according to another embodiment is an advantage with regard to the setting up of great temperature differences in the liquids of which the temperatures are to be regulated.

With the development of the invention according to another embodiment it is also possible to achieve very great temperature differences, in which case, if desired, the pipes may again be produced from the same material.

Also the development of the invention according to another embodiment is advantageous with regard to the setting-up of great temperature differences between the liquids.

In a temperature-regulating apparatus according to another embodiment, with the same mechanical construction of the unit formed by the temperature-regulating member and pipes, different temperature differences can be set up between the liquids of which the temperatures are to be regulated, since by increasing the through put through the pipe connected to the temperature-regulating member with a lower thermal impedance, the flow of heat to the remaining pipes is correspondingly reduced.

In a temperature-regulating apparatus according to another embodiment, the temperature of the various liquids at the outlet side can be measured separately directly at the temperature-regulating device.

According to another embodiment the temperature of the liquids flowing in can be measured in a corresponding manner. Thus a temperature-regulating apparatus, which has both the features described above and also has the advantage that it is constructed completely symmetrically, so that if necessary the inlet side and outlet side can be exchanged.

If according to another embodiment a temperature sensor connected to the temperature-regulating member is used, then by way of its output signal a correct acceptance of the heating or cooling capacity by the various liquids circulating through the pipes can be controlled. An output signal of this temperature sensor rising or falling inadmissibly sharply can be used to achieve protection against running dry.

The development of the invention according to another embodiment is advantageous with regard to a simple manufacture of the temperature-regulating apparatus based on commercially available pipe material and commercially available temperature-regulating members.

With the development of the invention according to another embodiment, it is possible to bring the liquid temperatures to the desired reference temperatures particularly quickly, in that one carries out the control of the heating or cooling capacity in the initial stage first of all according to the difference between the inlet temperature and reference temperature, whereas towards the end of the regulating process one changes over to a control depending on the difference between the outlet temperature and the reference temperature.

The invention is described in detail hereafter by means of several embodiments referring to the drawings, in which.

Figure 1:
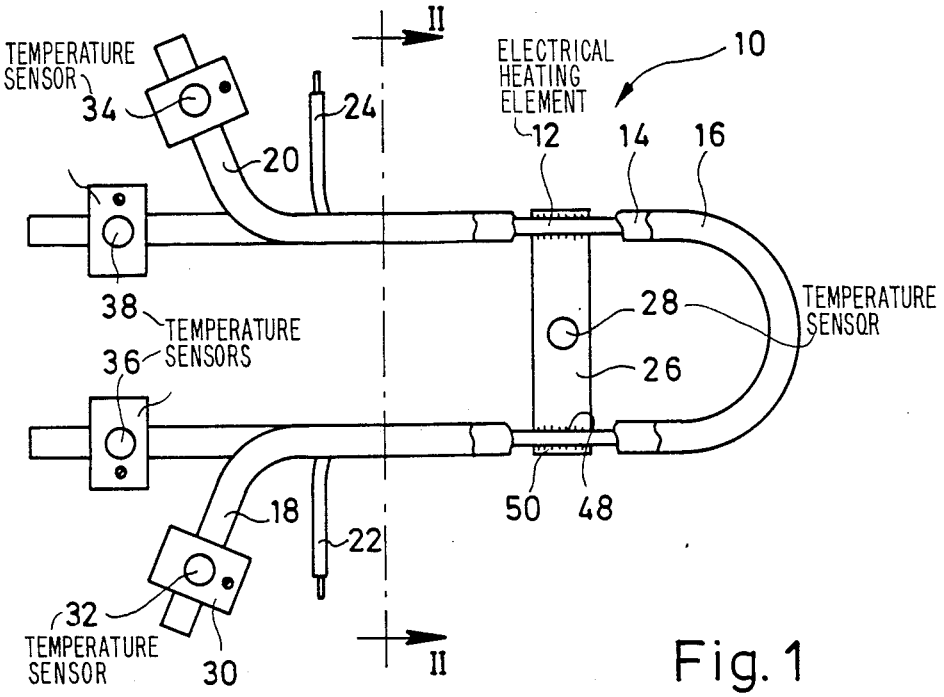
FIG. 1 is a plan view of a temperature-regulating unit for heating two liquids to different temperatures.

In FIG. 1, a temperature-regulating unit is designated generally by the reference numeral 10. It consists of an electrically operated heating element 12 located at the bottom of a first pipe 14 welded to this element and of an upper pipe 16 welded to the latter.

Seen in plan view, the heating element 12 and the pipes 14 and 16 each have a U-shaped construction and in their main section lie one above the other in alignment. Whereas the pipe 14 is exactly U-shaped, the pipe 16 has an end section 18 on the inlet side which is bent outwards and an end section 20 on the outlet side which is bent outwards. The heating element 12 similarly has bent ends sections 22, 24.

The sides of the heating element 12 are connected approximately in the centre of its longitudinal extent by a welded plate 26, on which a temperature sensor 28 is seated. Temperature sensors 32, 34 are seated in a similar manner by way of clamped supports 30 on the end sections 18 and 20 of the pipe 16 guided separately. Corresponding temperature sensors 36, 38 are fitted to the free ends of the pipe 14.

Figure 2:
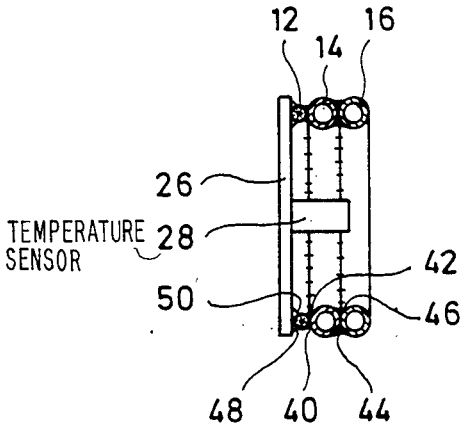
FIG. 2 is a section through the temperature-regulating unit according to FIG. 1 along section line II—II.

The pipes 14 and 16 and the outer casing of the heating element 12 as well as the plates 26 are preferably made from the same material, for example high-grade steel, so that they can be connected satisfactorily by welding, as indicated diagrammatically at 40 to 50 in FIG. 2.

The above described temperature-regulating unit 10 operates in the following manner:

The heating element 12 is heated by way of a power source not shown in detail. Heat is transferred to the pipe 14 by thermal conduction, so that a liquid circulated through the pipe 14 is heated in a corresponding manner. A liquid circulated at the same time through the pipe 16 is positively unable to reach a higher temperature than that of the liquid circulated through the pipe 14, since the entire supply of heat to the pipe 16 takes place by way of the pipe 14.

If as a result of a breakdown of the circulating pump associated with the pipe 14 and/or the pipe 16, the heat produced by the heating element 12 is not dissipated in an orderly manner, then the temperature sensor 28 is exposed to an increased temperature and its output signal can be used for automatically switching off the heating element 12.

In the temperature-regulating unit illustrated in FIGS. 1 and 2, the temperature difference between the liquid circulating through the pipe 14 and the liquid circulating through the pipe 16 depends on the thermal conductivity of the materials from which the pipes 14 and 16 are made, on the wall thickness of the pipes 14 and 16, on the thermal conductivity of the welds 44 and 46 and on the speed of flow in the pipe 14 and on the respective heating capacity. Whereas most of the above mentioned parameters can no longer be influenced after the mechanical manufacture of the temperature-regulating unit, the temperature difference between the two liquids can still be adjusted by way of the speed of flow in the pipe 14. It is obvious that with a very low speed of flow in the pipe 14, the liquid circulated through the pipe 16 may reach a temperature which is close to that in the pipe 14. If the speed of flow in the pipe 14 is increased, then on the other hand a greater proportion of the quantity of heat is carried away by the first liquid.

Figure 3:
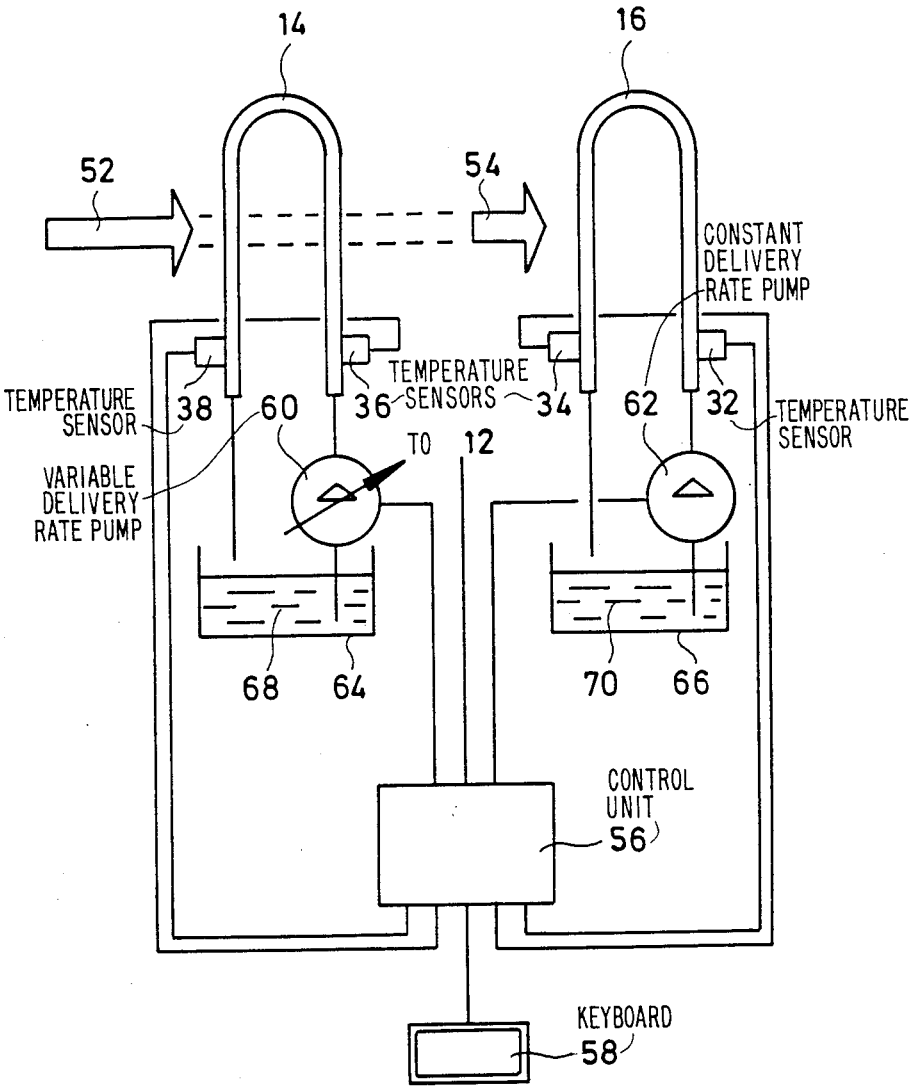
FIG. 3 is a block diagram of a temperature-regulating apparatus, which comprises a temperature-regulating unit according to FIG. 1 and additional pieces of equipment for setting-up the temperature difference between the two liquids.

FIG. 3 shows a temperature-regulating device with adjustable temperature difference between the two liquids, in which case only the pipes 14 and 16 of the temperature-regulating unit illustrated in FIGS. 1 and 2 are shown diagrammatically. An arrow 52 symbolises the flow of heat emitted by the heating element 12, whereas a further arrow 54 represents the lesser flow of heat passing by way of the pipe 14 to the pipe 16.

A control unit 56 receives the output signals from the temperature sensors 32 to 38. The reference temperature values for the two liquids circulating through the pipes 14 and 16 can be pre-set in the control unit 56 by way of a keyboard 58.

The outputs of the control unit 56 are connected to the control terminals of a first circulating pump 60 with a variable delivery and of a second circulating pump 62 with a constant delivery. The circulating pumps 60 and 62 draw liquid of which the temperature is to be regulated from the tanks 64 and 66 and convey the corresponding liquids 68, 70 through the pipe 14, 16, from which the liquids are returned to the associated tank. The corresponding connecting pipes, which are shown in FIG. 3 by dashes, may in practice be formed by flexible hoses, which are simply attached to the ends of the pipes 14 and 16 by means of hose clips.

Roughly speaking the above described control unit operates so that it regulates the heating capacity first of all according to the difference between the reference temperature and the temperature measured by the sensor 36 at the inlet of the pipe 14. On approaching the reference temperature, one then changes over to regulation depending on the output signal of the temperature sensor 38 at the outlet side.

The output signals of the temperature sensors 32 and 34 are used to control the delivery of the circulating pump 60, in which case again in a first stage the control takes place according to the difference between the reference temperature and the output signal of the temperature sensor 32 at the inlet side, whereas on approaching the reference temperature, regulation takes place using the output signal of the temperature sensor 34.

From the above description of the temperature-regulating unit 10 it is clear that the liquid circulated through the pipe 16 can therefore never have a higher temperature than the liquid circulated through the pipe 14, because the thermal inpedance between the pipe 16 and heating element 12 is greater than the thermal impedance between the pipe 14 and the heating element 12.

Figure 4:
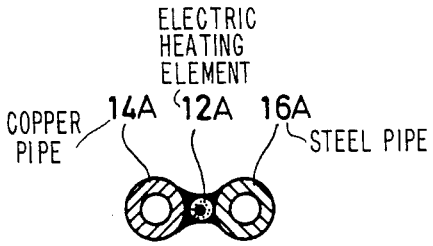
FIGS. 4 to 6 are cross sectional views showing alternative arrangements for joining an electric heating element to two separate pipes for conducting different liquids.

Whereas in the embodiment according to FIGS. 1 and 2, this relationship between the thermal impedances is maintained on the basis of the stacking arrangement of heating element 12 and pipes 14 and 16 chosen in this case, in the embodiment according to FIG. 4, which represents a cross section through one side of a modified temperature-regulating unit, different materials are used for the pipes 14A and 16A. Thus for example the pipe 14A illustrated may be made from copper, whereas the pipe 16A is made from high-grade steel. Both pipes are connected by welds to the heating element 12A located therebetween. The heating element as the hottest part of the temperature-regulating unit is thus protected against direct contact, whereas at the same time it is again ensured that the liquid circulating through the pipe 14 has a higher temperature than the liquid circulating through the pipe 16.

Figure 5:
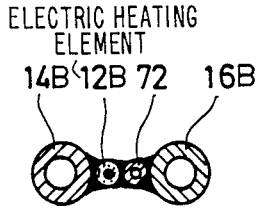

FIG. 5 shows a similar cross section to FIG. 4, but the requirement is made of this temperature-regulating unit that the same material is used for the pipes 14 and 16. In the temperature-regulating unit according to FIG. 5, the heating element 12B is also located between the pipes 14B and 16B. In the embodiment according to FIG. 5, a higher total heat resistance between the pipes 16B and the heating element 12B is ensured due to the fact that a tubular resistance member 72 is introduced between the heating element 12B and the pipe 16, but through which liquid does not flow.

Figure 6:
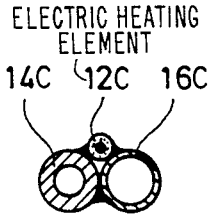

In the embodiment according to FIG. 6, the heating element 12C is welded to the contact point of two pipes 14C and 16C lying one beside the other, in which case the pipes 14C and 16C are made from the same material and have the same outer diameter but a different wall thickness. In this way it is also ensured that a greater proportion of the flow of heat emitted by the heating element 12C passes to the pipe 14C and the liquid circulating through the latter reaches a higher temperature than the liquid circulating through the pipe 16C.

It was common to the above-described embodiments that in the conveying direction of the liquid they overlapped each other to the same extent with the heating element 12C. The different thermal impedance resulted from the different transverse geometry of the material.

Figure 7:
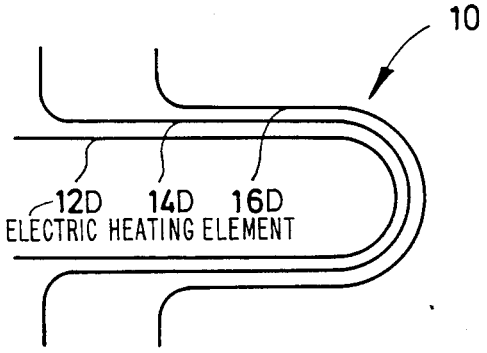
FIG. 7 is a diagrammatic plan view showing another possible arrangement for two liquid conducting pipes and an electric heating element.

The embodiment according to FIG. 7 shows a different total heat resistance between the pipe 14 and heating element 12D or pipe 16D and heating element 12D, which is also achieved with symmetrical radial geometry of the material, since those sections over which the pipes are in heating-conducting contact with the heating element 12D are of different lengths. The pipe 14D follows the heating element 12D over a greater distance than the pipe 16D, so that the liquid circulating through the pipe 14D necessarily has a higher temperature than the liquid circulating through the pipe 16D.

It will be understood that the "longitudinal variation" of the thermal impedance according to FIG. 7 can be combined with the "transverse variation" of the thermal impedance, as was described above with reference to FIGS. 1 to 6.

We claim:

1. Apparatus for adjusting the temperature of a plurality of liquids, comprising temperature adjusting means having a corresponding plurality of separate flow paths, a pump arrangement for circulating the liquids through said separate flow paths of said temperature adjusting means and comprising means for maintaining predetermined temperature differences between the liquids, characterized in that the temperature adjusting means includes a single temperature controlling member (12) and a number of pipes (14, 16) which correspond in number to the number of separate flow paths for the liquids of which the temperatures are to be adjusted, the temperature controlling member (12) and the pipes (14, 16) being interconnected in heat conducting manner such that the total thermal impedance between the first (14) of said pipes and the temperature controlling member (12) integrated from the inlet end to the outlet end of said first pipe differs from the corresponding total thermal impedance of at least a second (16) of said pipes, in that said first (14) of the pipes is located directly in heat conducting manner on the temperature controlling member (12) and said at least a second of said pipes is carried by said first (14) of said pipes in a heat conducting manner, the thermal impedance defined between said at least a second (16) of the pipes and the temperature controlling member (12) being thus formed by said first (14) of the pipes.

2. Apparatus according to claim 1 characterized in that the pipes (14, 16) each have different wall thicknesses.

3. Apparatus according to claim 1 characterized in that the pipes (14, 16) are each coupled thermally to the temperature-controlling member (12) over sections of different length.

4. Apparatus according to claim 1 characterized in that said pump arrangement includes a circulating pump with controllable delivery associated with the first one of the pipes (14), which pipe has the lowest thermal impedance with respect to the temperature-adjusting member (12).

5. Apparatus according to claim 1 characterized in that temperature sensors (34, 38) are fitted to the end sections of each pipe (14, 16) on its outlet side.

6. Apparatus according to claim 1 characterized in that temperature sensors (32, 36) are fitted to the end sections of each pipe (14, 16) on its inlet side.

7. Apparatus according to claim 1 characterized in that a temperature sensor (28) is connected to the temperature-controlling member (12).

8. Apparatus according to claim 1 characterized in that the temperature-controlling member (12) and the pipes (14, 16) have a U-shaped construction.

9. Apparatus according to claim 8 characterized in that the temperature sensor (28) connected to the temperature-controlling member (12) is seated on a plate (26) connecting the two sides of the U-shaped temperature-controlling member (12).

10. An apparatus for controlling the temperatures of a plurality of liquid streams comprising in combination (a) a first metallic pipe for transporting a first liquid, (b) a second metallic pipe for transporting a second liquid, (c) first pump means for causing said first liquid to move through said first pipe and second pump means for causing said second liquid to move through said second pipe, and (d) an elongated electrical heating element for generating heat;

said elongated electrical heating element being joined directly to said first metallic pipe along a substantial portion of its length in a heat conducting manner so that the heat generated by said heating element will be imparted by conduction to said first metallic pipe, said second metallic pipe being joined directly to said first metallic pipe along a substantial portion of its length in a heat conducting manner so that a portion of the heat imparted to said first metallic pipe by said electrical heating element will be in turn transferred by conduction to said second metallic pipe, the thermal impedance between said electrical heating element and said first metallic pipe being less than the thermal impedance between said electrical heating element and said second metallic pipe.

11. An apparatus according to claim 10 wherein the wall thickness of said first metallic pipe is different from that of said second metallic pipe.

12. An apparatus according to claim 10 wherein the metal of said first pipe is different from that of said second pipe.

13. A method for establishing a temperature difference in a plurality of liquid streams flowing through separate metallic pipes which comprises (a) generating heat in the liquid in one of said metallic pipes by positioning an electrical heating element in direct heat conducting engagement with said one of said metallic pipes, (b) generating heat in the liquid in another of said metallic pipes by joining said another metallic pipe to a portion of said one of said metallic pipes along a portion of its length, (c) controlling the flow of liquids through said metallic pipes, and (d) establishing a thermal impedance between said electrical heating element and said one of said metallic pipes that is less than the thermal impedance between said electrical heating element and said another of said metallic pipes.

* * * * *